US008375722B2

(12) United States Patent
Pilatis et al.

(10) Patent No.: US 8,375,722 B2
(45) Date of Patent: Feb. 19, 2013

(54) FLOW MODULATION METHOD AND APPARATUS

(75) Inventors: Nickolaos Pilatis, Warrington (GB); Arthur L Rowe, Derby (GB)

(73) Assignee: Rolls-Royce plc, London (GB)

( * ) Notice: Subject to any disclaimer, the term of this patent is extended or adjusted under 35 U.S.C. 154(b) by 1145 days.

(21) Appl. No.: 11/822,204

(22) Filed: Jul. 3, 2007

(65) Prior Publication Data

US 2008/0011073 A1 Jan. 17, 2008

(30) Foreign Application Priority Data

Jul. 12, 2006 (GB) ..... 0613781.4

(51) Int. Cl.
*G01M 15/14* (2006.01)

(52) U.S. Cl. ..... 60/752; 60/803; 60/39.78; 181/213; 239/265.19; 73/112.01; 73/112.03; 73/116.01; 73/116.03; 73/118.01; 431/9; 431/115; 431/116

(58) Field of Classification Search ..... 181/213, 181/215; 239/265.19; 60/752, 39.78, 803; 366/147, 168.2, 241, 279, 280; 73/112.01, 73/112.03, 116.01, 116.03, 118.01; 431/8, 431/9, 115, 116

See application file for complete search history.

(56) References Cited

U.S. PATENT DOCUMENTS 3,970,253 A * 7/1976 Burkes et al. ..... 239/265.19
3,985,094 A * 10/1976 Stricker ..... 440/47
6,220,852 B1 * 4/2001 Moore ..... 431/8

FOREIGN PATENT DOCUMENTS

JP 3 012 522 1/1991

OTHER PUBLICATIONS

Wachsman, et al. "Sensors and Actuators for Combustion Control," Proceeding of the 2004 American Control Conference, Boston Mass., Jun. 30-Jul. 2, 2004.

AE3051 Experimental Fluid Dynamics, Copyright 1999, 2000, 2002-2005 McMahon, et. al. pp. 1-17.

* cited by examiner

*Primary Examiner* — Ehud Gartenberg
*Assistant Examiner* — Steven Sutherland
(74) *Attorney, Agent, or Firm* — Jeffrey S. Melcher; Manelli Selter PLLC

(57) ABSTRACT

An apparatus and method for inducing waves within a container arranged to permit a through-flow of fluid flowing generally from an inlet of the container to an exit of the container, wherein the container has wave inducing means located at the exit of the container, the wave inducing means being operable to vary the area of the exit thereby inducing waves within the container. The apparatus may form part of a combustor test rig.

15 Claims, 3 Drawing Sheets

FLOW MODULATION METHOD AND APPARATUS

CROSS-REFERENCE TO RELATED APPLICATIONS

This application claims foreign priority under 35 U.S.C. 119 and 365 to United Kingdom Patent Application No. GB 0613781.4, filed 12 Jul. 2006.

BACKGROUND OF THE INVENTION

This invention concerns a method and apparatus for modulating the flow and pressure of a fluid passing through a container and in particular through a combustor assembly.

A gas turbine engine typically comprises in flow series order a compressor, a combustor and a turbine. Air entering the compressor is compressed before fuel is added and in the combustor and ignited. The resultant hot gasses pass to the turbine where they are expanded to produce work that is used to power the compressor and additionally to provide thrust, further work or electrical power.

The combustion process can create thermoacoustic instabilities within the combustor that can interact with the combustion process to provide areas of poor combustion, exaggerated acoustic waves that could damage the combustor and noise such as, for example, rumble.

It is desirable to model the interaction of the acoustic wave field with the combustion process in order to understand the unsteady characteristics of the combustion process. Once the characteristics are understood it becomes possible to address and potentially absorb damage and noise problems.

In a known rig a series of forced, but controlled wave-fields are imposed onto the burners in a combustor arrangement by a siren. The siren has a first rotating parallel plate and a second static parallel plate spaced axially from the first plate. The first plate rotates about an axis that is generally parallel with the combustor axis. Each plate has a series of holes that periodically align to create an unsteady flow and acoustic waves.

Since the combustor produces high temperatures it is necessary to position the siren upstream of the combustion chamber to prevent significant damage. The siren presents a large surface area which is difficult to cool and is easily damaged by combustion gasses. The siren can not be acceptably applied to the high pressures and high air mass flow rates within the combustor during operation and is limited to within laboratories at much lower pressures and temperatures than typically observed in the industrial use of a gas turbine engine. Clearly this leads to incorrect modelling of the acoustic process.

SUMMARY OF THE INVENTION

It is an object of the present invention to seek to overcome these and other problems by providing an improved apparatus and method for inducing waves.

According to the present invention there is provided apparatus for inducing waves within a container arranged to permit a through-flow of fluid flowing generally from an inlet of the container to an exit of the container;

wherein the container has wave inducing means located at the exit of the container, the wave inducing means being operable to vary the area of the exit thereby inducing waves within the container.

Preferably the wave inducing means are rotatable and where the container has an axis extending between the inlet and the exit and the wave inducing means are rotatable around an axis perpendicular to the container axis.

The wave inducing means may be elongate and have a polygonal cross-section. The cross-section is preferably square or hexagonal.

Preferably the wave inducing means is located at the exit such that a flow of fluid through the container may diverge at the wave inducing means, flow around the wave inducing means and re-converge downstream of the wave inducing means. Alternatively, the container exit may be defined between at least two walls, at least one wall having a cavity, the wave inducing means being partially sheltered thereby.

The wave inducing means may be induced to rotate by the flow of fluid. Preferably the wave inducing means is functionally mounted to a drive motor adapted to rotate the wave inducing means.

Preferably the wave inducing means are adapted to be cooled. The wave inducing means may comprise at least one cooling passages for the provision of cooling fluid.

Preferably the container is a combustor assembly and preferably the exit is a transition tube mounted to a combustor.

Preferably the apparatus according to the invention is part of a combustor test rig.

According to another aspect of the invention there is provided a method of inducing waves within a combustor having an inlet and an exit comprising the steps of providing wave inducing means at the exit of the combustor that is operable to vary the area of the exit of combustor, the flowing air through the combustor between the inlet and the outlet and operating the wave inducing means thereby varying the exit of the combustor.

Preferably the wave inducing means is rotated to vary the exit of the combustor assembly. Preferably the wave inducing means is rotated about an axis that is perpendicular to the axis of the combustor that extends generally between the inlet and the exit thereof.

BRIEF DESCRIPTION OF THE DRAWINGS

Embodiments of the present invention will now be described by way of example only and with reference to the accompanying drawings, in which:—

DETAILED DESCRIPTION OF THE INVENTION

Figure 1:
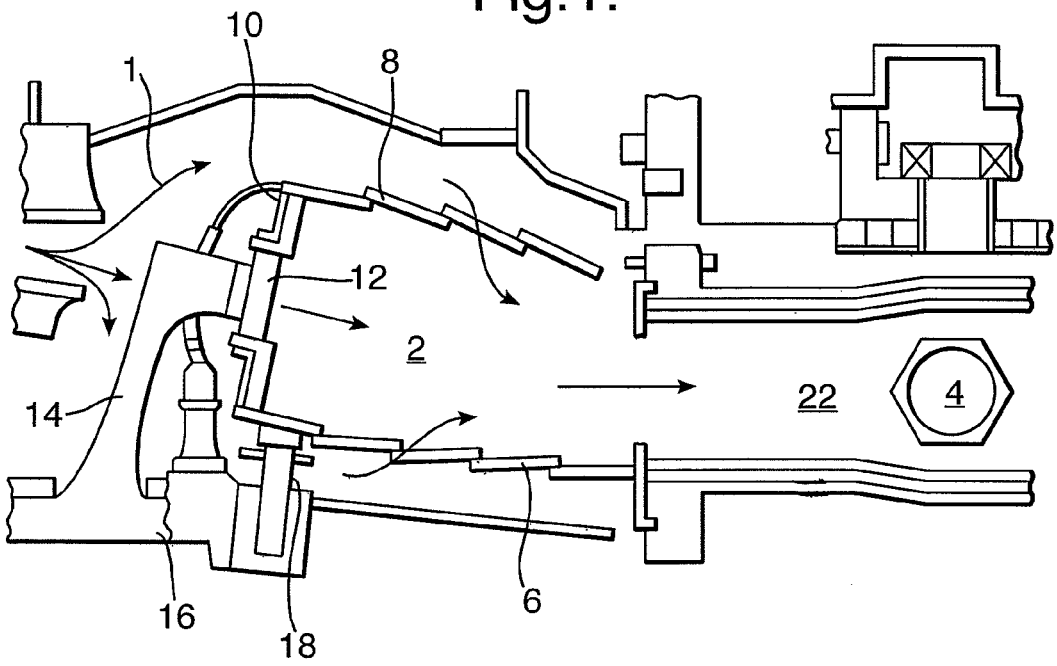
FIG. 1 depicts a combustor assembly provided with wave inducing means.

FIG. 1 shows a combustor 2 having a wave inducing means 4 according to the invention. The combustor has an inner circumferentially extending wall 8 and an outer circumferentially extending wall 6. A bulkhead 10 at the upstream end of the combustion chamber houses a fuel injector 12. A strut 14 connects the injector with the exterior of the combustor casing 16 and provides passageways for the supply of fuel to the injector 12.

Air is supplied during operation of the combustor in a direction as symbolized by the arrows 1. In modern "lean burn" combustors the majority of the air is supplied through the fuel injector, with remaining air supplied through cooling holes or dilution holes in the inner and outer combustor walls 6, 8.

Fuel supplied to the combustor is ignited by an igniter 18 and the resultant hot combustion gasses pass from the combustor to a turbine section via a transition tube 22. Ignition and deflagration of the fuel is an unsteady state process that generates acoustic waves within the combustor. The acoustic waves are periodic in nature and thus are difficult to model and it is difficult to understand the interaction between the wave field and the combustion process.

A wave inducing means 4 is provided at the exit of the combustor assembly to induce specific pressure waves. Their effect on the combustion process can then be assessed and modelled.

Figure 2:
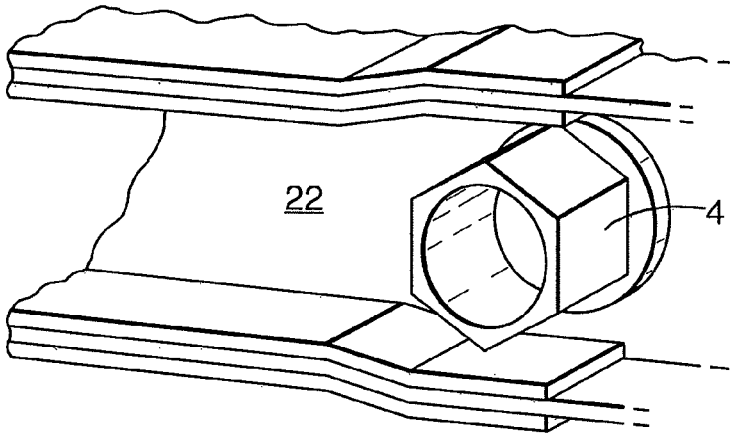
FIG. 2 depicts a perspective view of a cut away of the wave inducing means of FIG. 1

The structure of the wave inducing means will be discussed in greater detail with respect to FIGS. 2 to 4. In one embodiment the wave inducing means 4 comprises a rotatable structure mounted across the combustor assembly exit. The structure has an axis that is perpendicular to the major axis of the combustor defined generally by the flow of air through the combustor 2.

The structure comprises a hexagonal portion mounted to a circular shaft. The shaft rotates and as it does so the face presented to the flow of air and the angle of the face(s) thus presented alters dynamically. This also varies the area of the exit open for the flow of fluid. Combustion gasses flowing through the duct 22 diverges at the hexagonal structure 4 and flows around the structure 4 before re-converging downstream of the structure.

In one form the structure is adapted to rotate because of the flow of fluid. As the structure rotates the exit area of the combustor assembly varies. The variation in area induces acoustic waves which propagate upstream within the combustor 2 and interact with the combustion process in a known and repeatable manner. The resultant interactions are detected by a plurality of sensors (not shown) that are spaced around the walls of the combustor 2.

As the induced pressure waves are of a repeatedly known magnitude and directionality it is possible to model the interaction from the recorded data.

Figure 3:
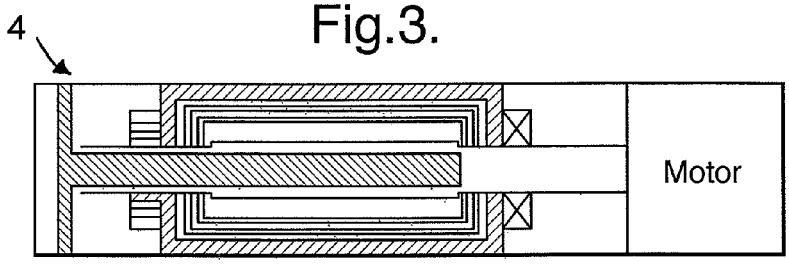
FIG. 3 depicts an end view of the wave inducing means of FIG. 1.
Figure 4:
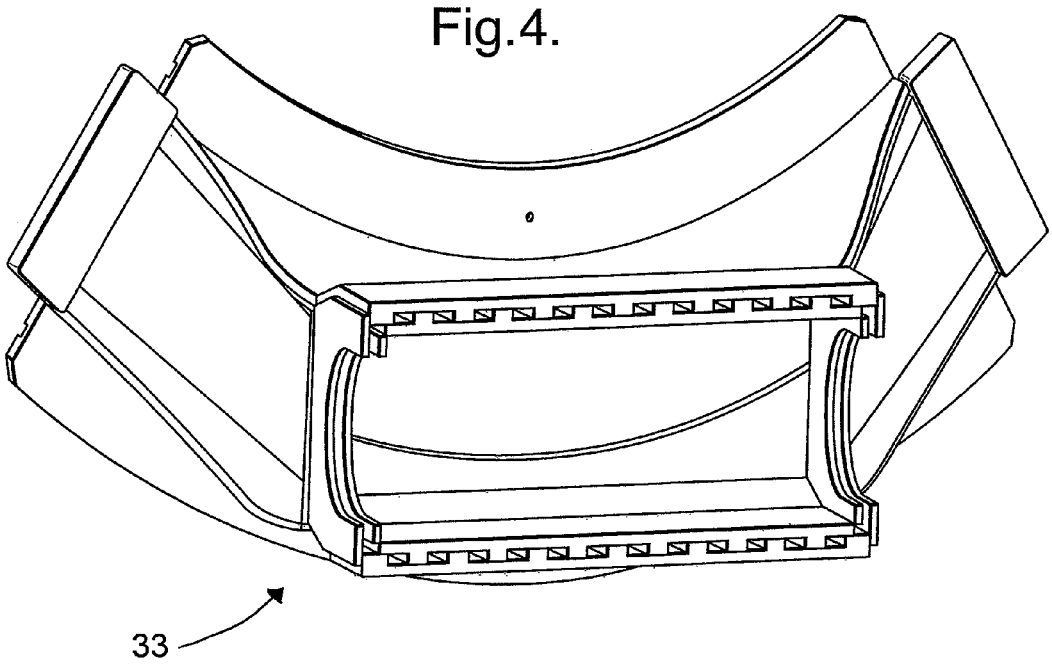
FIG. 4 is a perspective view of an exemplary combustor exit.

In an improvement, as depicted in FIG. 3, the hexagonal shaft is functionally attached to a motor. The motor enables the shaft to be rotated at a selected speed and in a selected direction to induce alternative acoustic waves within the combustor.

It will of course be apparent that the acoustic waves may be sensed and modelled by operating the wave inducing means in a combustor arrangement whilst air is directed through the combustor at operational velocities, but the fuel (or fuel substitute) is not ignited.

The wave inducing means is subject to high temperatures produced when the fuel is burned. These temperatures can be of the order 1400K to 1600K. The shaft can be made out of high temperature materials such as ceramic that can withstand such extreme conditions but, more preferably, it is cooled and need not be made from such specialist materials. To this end, the hexagonal shaft is hollow and is supplied with a continuous passage of air to ensure adequate cooling.

The rotating shaft also preferably cooperates with the combustor exit 33 in a defined manner. As shown in FIG. 4, the exit 33 may be dimensioned to direct air through a "letter box" opening into which the shaft is placed. Beneficially, for a test-rig incorporating a combustor with such wave inducing means both the letter box and the shaft are replaceable with letter boxes and shafts of different shapes and sizes. In this way the test rig is able to produce a wider array of waves within the combustor and therefore more comprehensive testing of the interactions between the waves and the combustion process. The flow at the combustor exit will be choked.

Figure 5:
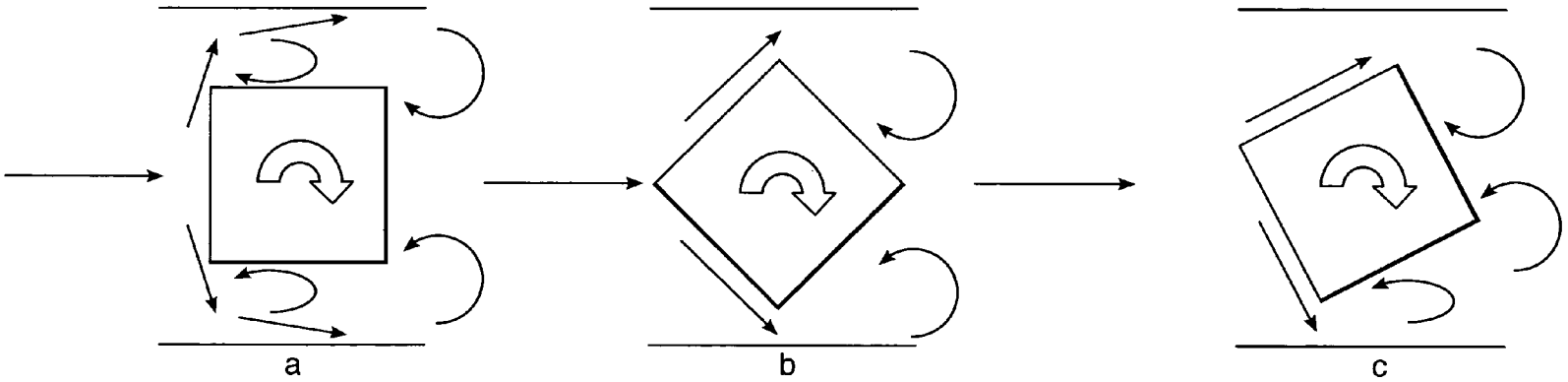
FIG. 5 depicts operation of a wave inducing means of a first embodiment.
Figure 6:
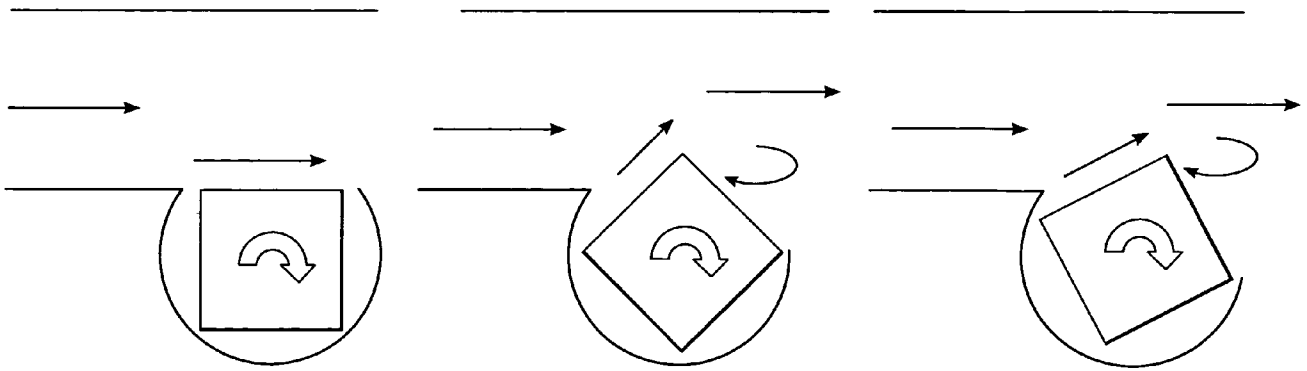
FIG. 6 depicts operation of a wave inducing means of a second embodiment.

FIG. 5 depicts an alternative arrangement operating in the preferred manner. The wave inducing means has a square cross-section mounted mid-stream in the flow of air through the exit of the combustor arrangement. As the cross-section is square there is a greater net change in the area of the exit available for the passage of air between the point of greatest area 5*a* and the point of least area 5*b* than for the situation where the cross-section is hexagonal.

In an alternative embodiment the wave inducing means is embedded in the wall of the exit of the combustor arrangement. In this arrangement the net change in the area of the exit available for the passage of air is less than that of the hexagonal or square cross-section wave inducing means described above.

Various modifications may be made without departing from the scope of the invention. For example, cross-sectional shapes of the wave inducing means may not necessarily be square or hexagonal. Other polygonal shapes are appropriate depending on the form and nature of the acoustic waves to be produced. It will also be appreciated that circular shafts may be used provided that they are provided with paddles or other features to render the shaft axisymetric.

As described above the rotatable shaft may be placed in the full flow of the exit air or it may be partially sheltered in one of the exit walls. The degree of shelter is dependent on the nature and form of the acoustic waves to be produced.

It will also be appreciated that multiple shafts may be provided to increase the complexity of the acoustic waves produced.

In a further embodiment the rotatable shaft, or a further rotatable shaft is located upstream of the fuel injector. The shaft is operable to rotate independently of any shaft at the combustor exit to provide additional pressure waves to the combustor. Complex pressure waves can be produced.

Whilst the invention has been described with respect to combustion chambers, the invention is applicable to other containers having a through flow of fluid in which it is desirable to generate pressure waves for test or other reasons.

We claim:

1. Apparatus for inducing periodic pressure waves within a gas turbine combustor assembly to model the acoustic process within the gas turbine combustor assembly, comprising:

a gas turbine combustor assembly having an inlet and an exit, the combustor is arranged to permit a through-flow of fluid flowing generally from the inlet to the exit during use;

wave inducing means located at the exit, the wave inducing means is constructed to continuously rotate about an axis that is perpendicular to an axis of the combustor that extends between the inlet and an outlet at the area of the exit, and also constructed such that when the wave inducing means is continuously rotated unidirectionally to vary the area of the exit, periodic pressure waves having a repeatedly known magnitude and directionality within the combustor are produced; and at least one sensor constructed to detect interactions between the pressure waves and the combustion process within the combustor assembly to determine the effect of the periodic pressure waves on the combustion process during use.

2. Apparatus according to claim 1, wherein the wave inducing means is elongate and has a polygonal cross-section.

3. Apparatus according to claim 2, wherein the wave inducing means has a square cross-section.

4. Apparatus according to claim 2, wherein the wave inducing means has a hexagonal cross-section.

5. Apparatus according to claim 1, wherein the wave inducing means is located at the exit such that during use a flow of fluid through the combustor assembly may diverge at the wave inducing means, flow around the wave inducing means and re-converge downstream of the wave inducing means.

6. Apparatus according to claim 1, wherein the combustor assembly exit is defined between at least two walls, at least one wall having a cavity, the wave inducing means being partially sheltered within the cavity.

7. Apparatus according to claim 1, wherein the wave inducing means is capable of rotation by the flow of air past the wave inducing means during use.

8. Apparatus according to claim 1, wherein the wave inducing means is functionally mounted to a drive motor adapted to rotate the wave inducing means.

9. Apparatus according to claim 1, wherein the wave inducing means is adapted to be cooled.

10. Apparatus according to claim 9, wherein the wave inducing means comprises at least one cooling passage for the provision of cooling fluid.

11. Apparatus according to claim 1, wherein the exit is a transition tube mounted to a combustor.

12. Apparatus according to claim 11, wherein the combustor assembly comprises a fuel injector for injecting a fuel into the through-flow of fluid.

13. A method of inducing periodic pressure waves within a gas turbine engine combustor having an inlet and an exit to model the acoustic process within the gas turbine combustor assembly comprising the steps of:

providing wave inducing means at the exit of the combustor that is operable to vary the area of the exit of the combustor, the wave inducing means is constructed to continuously rotate about an axis that is perpendicular to an axis of the combustor that extends between the inlet and an outlet at the area of the exit;

flowing air through the combustor between the inlet and the outlet;

rotating the wave inducing means unidirectionally to continuously vary the area of the exit of the combustor thereby inducing periodic pressure waves having a repeatedly known magnitude and directionality within the combustor; and recording the effect of the pressure waves within the combustor.

14. A method according to claim 13, wherein the wave inducing means has a hollow cavity which is provided with a flow of cooling air.

15. A method according to claim 13, wherein the wave inducing means is induced to rotate by the air flowing through the combustor.

* * * * *